US006439705B2

(12) United States Patent
Eida

(10) Patent No.: US 6,439,705 B2
(45) Date of Patent: Aug. 27, 2002

(54) LIQUID PATH OPENING/CLOSING MECHANISM

(75) Inventor: Masataka Eida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/797,569

(22) Filed: Mar. 5, 2001

(30) Foreign Application Priority Data

Mar. 7, 2000 (JP) ..... 2000-062138

(51) Int. Cl.[7] ..... B41J 2/175
(52) U.S. Cl. ..... 347/85
(58) Field of Search ..... 347/84, 85, 87

(56) References Cited

U.S. PATENT DOCUMENTS 5,262,802 A 11/1993 Karita et al. ..... 347/87
5,751,300 A 5/1998 Cowger et al. ..... 347/6

FOREIGN PATENT DOCUMENTS

JP 57-26262 2/1982
JP 3-101944 4/1991
JP 7-243542 9/1995
JP 7-251507 10/1995
JP 9-89146 3/1997
JP 11-63275 3/1999

*Primary Examiner*—Anh T. N. Vo
(74) *Attorney, Agent, or Firm*—Fitzpatrick, Cella, Harper & Scinto

(57) ABSTRACT

Disclosed is an innovative, compact and light liquid flow path opening/closing device that is simply structured, that can be appropriately employed for controlling the flow of ink along the ink path of an ink-jet printer, and that operationally is reliable. According to the present invention, an electromagnetic driven liquid flow path opening/closing device comprises a highly permeable drive shaft, a spring for impelling the drive shaft in one direction, a bobbin case within which the drive shaft inside a cylindrical chamber is positioned, a coil wound around the outer face of the bobbin case, a pair of highly permeable cases in which the bobbin case around which the coil is wound is stored, and inlet and outlet joints, communicating with the cylindrical chamber of the bobbin case wherein the drive shaft is positioned, wherein the joints are opened by impelling the drive shaft to counter the urging force exerted by the spring.

20 Claims, 5 Drawing Sheets

LIQUID PATH OPENING/CLOSING MECHANISM

BACKGROUND OF THE INVENTION

1. Field of the Invention

The present invention relates to an opening/closing mechanism provided for a liquid path for a liquid or a gas, and relates in particular to a liquid path opening/closing mechanism that can control the movement of a small quantity of liquid.

The following explanation will be given for a liquid path opening/closing mechanism that is used for the ink supply path of an ink-jet recording apparatus, such as an ink-jet printer, a facsimile machine or a copier. However, the present invention is not limited to this field, and pertains to a liquid path opening/closing mechanism that can also be employed for pharmaceuticals (including liquids, liquids in which powder has been dispersed, and gases), or for liquids having a high degree of purity (e.g., super pure water).

Furthermore, the liquid path opening/closing mechanism can also be used for air or other liquids (detergents, juice, spices or seasonings). Since the liquid path opening/closing mechanism is safe and light because in operation little pressure is required, and since power consumption is low, this mechanism is especially preferable for small toys (toy robots), a market that it is predicted will expand.

2. Related Background Art

For the following explanation, an ink-jet recording field is employed.

There are two types of ink-jet recording apparatuses: a continuous type and an on-demand type.

An ink-jet recording apparatus of a continuous type sequentially ejects ink through nozzles at high pressure, and changes the ink ejection direction on the fly en route to perform printing or to form images.

In a recording apparatus, an opening/closing mechanism is provided along an ink channel that supplies and halts the supply of ink at the start and at the end of printing. A large high pressure opening/closing mechanism, i.e., about 20 mm wide, 30 mm high and 20 mm long, is constructed of a strong material, such as metal, and has a complicated internal arrangement.

As is disclosed in Japanese Patent Application Laid-open No. 3-101944, since an on-demand ink-jet recording apparatus is designed for the ejection of ink droplets by an ink-jet ejection device, high pressure need not be exerted on the ink, and ink need only be supplied from an ink tank to an ink-jet head. Further, ink is supplied from the ink tank to the ink-jet head under a slight negative pressure (by using a head difference or providing a negative pressure exertion mechanism for the ink tank), so that ink leakage at the ink-jet head is prevented.

Therefore, for an on-demand arrangement, an ink channel that connects an ink tank to an ink-jet head need not be opened or closed to supply ink, but rather, all that is required is that a pipe be permanently provided, so that the ink-jet head can use head difference to suck up the necessary amount of ink. Either this, or merely an ink cartridge method is required in which an ink absorption member is stored as a negative pressure exertion member in an ink tank and ink is retained in and supplied from the member.

However, in recent applications wherein ink-jet recording apparatuses are employed to record high-resolution images, such as photo images, instead of simply supplying black and three other colors, Y (yellow), M (magenta) and C (cyan), six or seven different ink colors, including dark and light shades, and a special color or a processing liquid are required.

In addition, since the number of prints increases in consonance with an increase in the printing speed, a large amount of ink is required, and accordingly, a large ink tank is a necessity, while the current trend, in accordance with popular demand, is for recording apparatuses to be reduced in size, and for, in the arrangement of the components in the recording apparatus, the ink tank to be located higher than the ink-jet head, although conventionally such an arrangement is not employed.

Furthermore, according to one method, ink is stored separately from the ink-jet head in a large ink container, and a pipe is employed to carry the ink from the container to the ink-jet head.

According to this method, there is a need for ink to be stored in the liquid state at a location higher than the ink-jet head, and to be supplied as needed.

However, a small ink flow controller and associated parts are required, so that the configuration can cope with a small ink-jet head and seven colors of ink, for example.

A practically sized controller for this purpose is one that is about 15 mm in height, 15 mm in length and 15 mm in width, or smaller.

When a large amount of ink stored in an ink tank is to be supplied along a tube or a pipe to an ink-jet head, the ink flow controller must be located at the outlet port of the ink tank or along the route followed by the ink flow.

However, since in this configuration the ink-jet head is fixed, for the following reasons it is not always preferable for this configuration to be employed for a serial printing system in which the ink-jet head is moved horizontally.

Due to the inertia when an ink-jet head is moved horizontally, pressure fluctuation occurs such that more ink is supplied than is necessary and a negative pressure is generated on the suction side thereby making the ejection of ink from the ink-jet head unstable. It was found that no particular problem arose during the conventional printing of letters or characters, but that when a high-resolution image, such as a photo image, was printed, a slight variance or deterioration in printing quality was noted.

This problem is disclosed in detail in Japanese Patent Application Laid-open No. 7-251507. According to the disclosed configuration, an opening/closing device for controlling the flow of ink is located on the side of an ink-jet head, adjacent to the outlet of a pipe. For this configuration, it is preferable that the opening/closing device for controlling the ink flow be light and compact, and that it exhibit a superior response property. However, the valve of the opening/closing device in Japanese Patent Application Laid-open No. 7-251507 is opened or closed either in the same direction as or in the opposite direction to the flow of ink, although the structure of the opening/closing device is not described. Further, according to this publication, when the size of the opening/closing device is increased the size of the recording apparatus is also increased.

The objective of the invention is to provide an opening/closing device for an ink flow path that resolves the above problem.

Thus, the present inventor purposely searched for an ink joint having an opening/closing device that would satisfy the above described requirements, but found none. And then, because they had to prepare a conventional ink joint, the present inventors examined available conventional techniques that could be used for the production of an ink joint, but again, could not find a desirable technique.

Conventional techniques applied for the production of opening/closing devices are disclosed in Japanese Patent Application Laid-open No. 9-089146, No. 7-243542 and No. 5-026262. However, none of the devices described in these publications is an ink joint, equipped with an opening/closing device, that is small and light enough for four to seven of them to be mounted on an ink-jet head.

In FIG. 5 is shown a conventional, comparatively simply structured opening/closing device that is disclosed in Japanese Patent Application Laid-open No. 7-243542, and in FIG. 6 is shown another conventional, comparatively simply structured opening/closing device that is disclosed in Japanese Patent Application Laid-open No. 9-089146.

In FIG. 5, the opening/closing device is employed as a valve for preventing backflow in a water pipe, etc., and as is shown in FIG. 5, the valve comprises: a case 68, a spring 62, a moving core 63, a coil 61, a valve rod 70, an operating valve body 71, and a coil support member 72.

In FIG. 6, the opening/closing device is a solenoid valve used for an oxygen cylinder for continuously supplying an adequate volume of oxygen to a hospital ward, etc., while an empty oxygen cylinder is being exchanged for a new, full cylinder. The solenoid valve comprises a coil 61, a spring 62, a valve rod 63, an auxiliary shaft 64, a sealing member 65, a ring-shaped iron core 66, an auxiliary member 67 and a case 68.

Further, in Japanese Patent Application Laid-open No. 57-026262, for which no drawing is supplied, a structure is disclosed for a valve driving mechanism having the improved response property of a fuel supply injector used for an automobile engine.

Very high pressures are used with these, conventional opening/closing mechanisms, and the structural members must not only be strong but must permit a high flow rate for the liquid that is used. Further, these mechanisms may be formed by machining metal castings or by directly machining masses of metal, and they are large structures for which reductions in size are not requested.

SUMMARY OF THE INVENTION

It is one objective of the present invention to provide a small, light, reliable opening/closing device having a simple structure that can not be implemented by the prior art.

As the main objective, it is demanded that the air flow rate and timing be controlled so only a comparatively low pressure is required for the precise supply of ink or another liquid. As previously described, a compact structure, light and simple, is preferable. At the least, one opening/closing device portion for the structure should have a weight equal to or less than 30 g and a size equal to or smaller than 4 $cm^3$, and should facilitate the supply and discharge of ink or another liquid.

Therefore, as the result of a purposeful study, it was found that in order to provide a compact structure, using a solenoid, that could provide the above function, a drive shaft must preferably be operated in a magnetic field, and for a compact structure, the magnetic flux density must be increased. Accordingly, it is necessary for a closed magnetic circuit to be formed to contain the magnetic flux, so that its external dispersion is prevented. As a result, an innovative structure was provided wherein the case of a solenoid valve was formed of a highly permeable material, a coil was located inside the case, and the drive shaft and the ink flow path were defined inside the coil.

Since the case and the drive shaft are about 10 mm in diameter and are equal to or less than 10 mm in height, it is impossible to reduce manufacturing costs when a normal cutting process is employed.

Therefore, to reduce manufacturing costs, a metal deep-drawing process was used for the case, composed of a highly permeable material, and cold forging was used for the drive shaft. Further, to reduce power consumption, wire having a diameter of 50 to 100 $\mu$m was employed as the winding for the coil, and a greater magnetic flux density was attained by increasing the number of windings. As a result, it was possible to manufacture, at low cost, a small valve that could open or close an air or liquid flow path under a pressure of approximately two atmospheres, and that had a power consumption of only 0.3 to 1.5 W.

Further, when wire having a diameter of 30 $\mu$m or 20 $\mu$m was employed, a further reduction in power consumption was possible.

Nevertheless, although momentary opening/closing of the valve was possible, a problem arose in that a leakage of approximately one to two drops a minute could not be prevented. Thereafter, as a result of a detailed discussion of this problem, it was confirmed that the ink leakage was the result of one or more of the following factors.

(1) A sealing gap was opened between the case and the drive shaft when the surface of the case was scratched during deep-drawing and minute raised and recessed portions were formed.

(2) A sealing gap was opened between the drive shaft and the case when the surface of the drive shaft was scratched during cold forging and minute raised and recessed surface portions were formed.

(3) A sealing gap was opened between the rubber seal and the drive shaft when the surface of the rubber seal, while being formed around the drive shaft, was slightly scratched and raised and recessed surface portions were formed.

Through a discussion to ascertain the feasibility of using deep-drawing to form an extremely smooth surface, it was ascertained that it was impossible to obtain a case having a smooth surface when the deep-drawing process was used for the case. This was because during deep-drawing slight scratching of the metal die that was used occurred, and because it was found that when the process was used for continuous production, an uncountable number of 10 $\mu$m scratches occurred in a period during which deep-drawing was repeatedly performed approximately 1000 times. Further, since during cold forging the metal die that was used was deformed, similar scratches occurred earlier than they did during the deep-drawing process, i.e., after the cold forging had been repeated 600 times.

In addition, since a gap appears between metal seals based on an error in the size precision, even when the case and the drive shaft have mirror faces, a slight gap is opened by a difference in the friction developed in the oblique direction and ink leakage occurs.

Therefore, a method was employed whereby a rubber member was used for sealing, and rubber seal was integrally formed with the drive shaft using compression junction, so that the drive shaft was sealed within the case. However, even with this method, obtaining a complete seal was impossible, and a slight ink leakage occurred.

As a result, it was found that when a scratch was formed inside a metal case, and when the surface of the rubber seal was also slightly scratched and the rubber was flat, deformation of the rubber seal could not pinch-off divide the scratch and the slightly raised and recessed portion by pinch-off division.

As a result of a discussion, to resolve this problem it was decided to either apply a flat resin coating to cover the scratch at the sealed portion of the metal case, or to change the shape of a bobbin case and form the sealed portion as a mirror face for the bobbin case.

Furthermore, the following means was employed as a method for resolving the problem posed by a scratch in the rubber seal and for increasing a pinched-off and deformed portion. To resolve the problem or to reduce the size of a scratch in the rubber seal, a flat pressing formation was not used to form the rubber, but instead, an emigration compression formation was employed to provide a mirror face for the rubber seal.

According to the method for increasing the pinched-off and deformed portion, when the sealing portion of the rubber seal was crest shaped and a pressing load was imposed to form a seal, the rubber seal portion at the summit of the crest could be easily flattened and the pinched-off and deformed portion increased.

In this manner, a compact, low power consumption solenoid valve could be produced.

When ink was not evacuated from the solenoid valve and the valve was maintained in the sealed state for an extended period of time, the opening and closing of the valve was impossible.

It was found that this was due to pseudo bonding of the rubber seal to the sealing face of the case, a condition occasioned by a reaction between the rubber seal and the ink element. Further, this effect was frequently witnessed when the sealing face of the case was coated with resin.

From these results, pseudo bonding is regarded as a reaction between the rubber seal and the ink element at the sealed face of the case, and impurities released by the two sealing members.

Thus, as a result of a purposeful study, a stable fluororubber was selected and employed as the rubber seal, which at low temperatures releases very few impurities and that neither reacts with organic materials nor swells nor contracts.

Further, the member whereon the sealed face of the case was formed was a resin coated layer, in particular, a coated layer prepared by baking, at a temperature of 300° C., polyimido, a stable material that seldom releases impurities when heated.

A resin bobbin composed of polysulfone, which does not contain a smoothing agent or release agent, was employed as a bobbin case integrally formed with the sealed face.

With this arrangement, a small ink supply solenoid valve could be manufactured that could stably be opened and closed, even after it had been sealed for an extended period of time.

A liquid flow path opening/closing device that can resolve the various problems listed above has the following arrangement. That is, according to the present invention, an electromagnetic driven liquid flow path opening/closing device comprises:

a highly permeable drive shaft;

urging force exertion means for impelling the drive shaft in one direction;

a bobbin case within which the drive shaft inside a cylindrical chamber is positioned;

a coil wound around the outer face of the bobbin case;

a pair of highly permeable cases in which the bobbin case around which the coil is wound is stored; and a liquid flow path, communicating with the cylindrical chamber of the bobbin case wherein the drive shaft is positioned, wherein the liquid flow path is opened by impelling the drive shaft to counter the urging force exerted by the urging force means.

With this arrangement, an electromagnetic force is generated by supplying an electric signal to the coil, and the drive shaft in the cylindrical chamber of the bobbin case is impelled to counter the urging force exerted by the urging force means while, in this fashion, opening the liquid flow path. With this structure, a compact opening/closing device can be implemented that is appropriate for flow control along the ink route of an ink-jet printer, and that has a mass equal to or less than 10 g and for operation requires only 1.2 W or less.

In the opening/closing device, it is preferable that the portion that is located opposite the direction in which the drive shaft is impelled by the urging force exertion means, and that contacts the drive shaft, be mounted inside the coil, in order to stabilize the shaft driving direction.

The portion to which the drive shaft is impelled by the urging force exertion means is a flat face integrally formed with the bobbin case, and rubber seal is provided at that portion of the drive shaft that is secured to the flat face, so that the liquid flow path is shielded by the flat face and the rubber seal. Or, a preferable arrangement is for the portion to which the drive shaft is impelled by the urging force exertion means to be a smooth face that is coated on the bottom of a recessed portion in one of the highly permeable cases, and for a rubber seal to be provided at that portion of the drive shaft that is secured to the smooth face, so that a seal is provided for the liquid flow path by the smooth face and the rubber seal. With this arrangement, during the drive idle time, the rubber seal attached to the drive shaft is transported to the flat face or the coated smooth face whereat there are no scratches and no raised or recessed portions, to provide preferable shielding for the liquid flow path.

It is preferable that anticorrosive layers that do not adversely react with ink be deposited on the faces of the highly permeable case and the drive shaft that are directly contacted by ink. The anti-corrosive layers can be polyimido evaporation layers or epoxy resin coated layers.

The rubber seal is fluororubber, and the sealing portion is crest shaped. According to this arrangement, when the surface of the rubber seal is scratched sightly and the rubber is flat, or when the rubber seal is deformed by splitting that occurs as a result of the scratch or at raised and recessed portions, and a good seal can not be provided, the problem can be resolved and a better, more complete shield can be provided for the ink flow path.

The highly permeable cases are formed by the deep-drawing of a highly permeable metal plate, and the drive shaft is manufactured by the cold forging of a highly permeable material. Thus, high productivity can be achieved at a low cost.

DETAILED DESCRIPTION OF THE PREFERRED EMBODIMENTS

The preferred embodiments of the present invention will now be described while referring to the accompanying drawings. In these embodiments, an opening/closing device for an ink supply path will be employed; however, this configuration can be employed for air or for a liquid other than ink.

(First Embodiment)

Figure 1B:
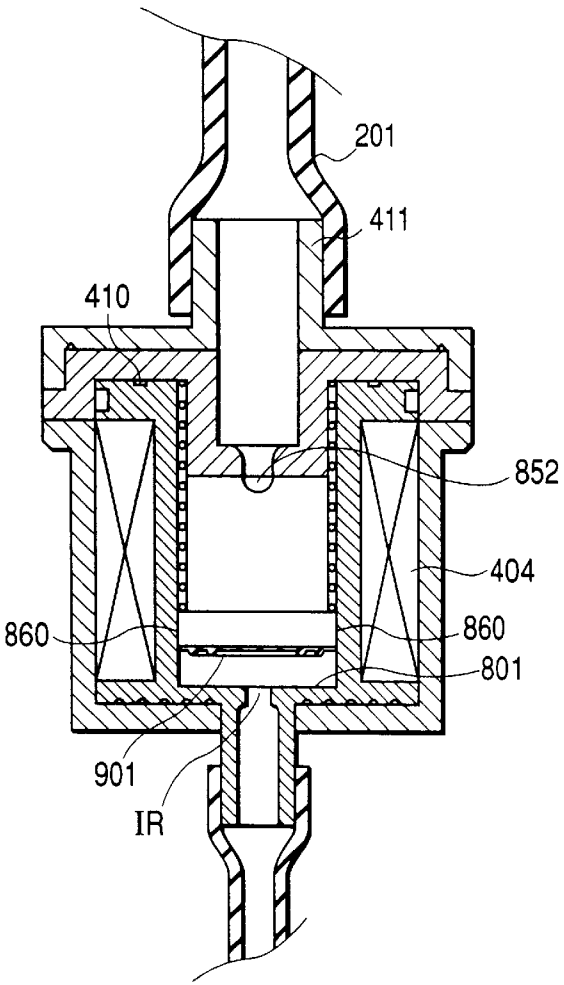
FIGS. 1A and 1B are schematic cross-sectional views for explaining the configuration of a liquid flow path opening/closing device according to a first embodiment of the present invention.
Figure 1A:
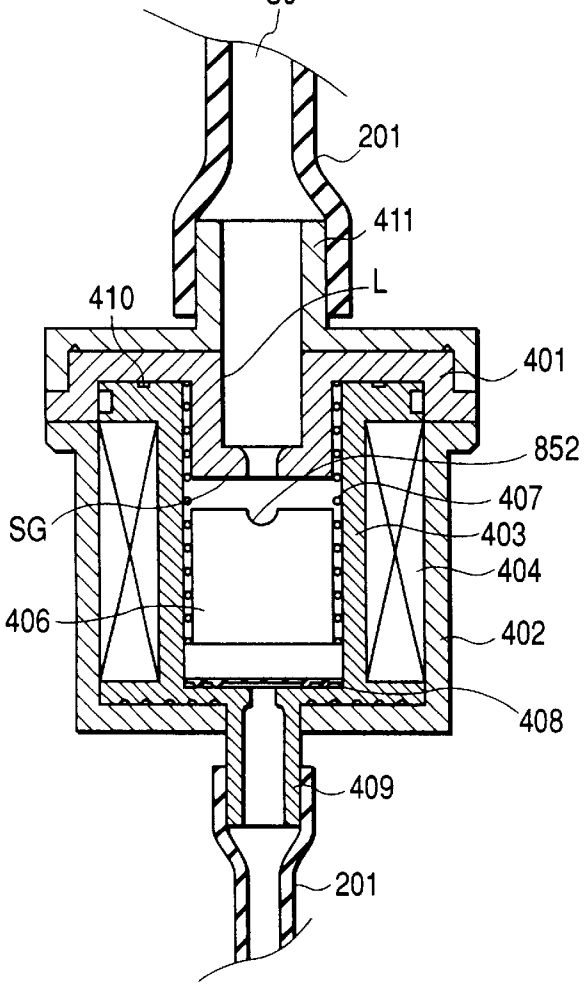

FIGS. 1A and 1B are schematic cross sectional views for explaining the arrangement of a liquid flow path opening/closing device according to a first embodiment of the invention. The flow path closed state is shown in FIG. 1A, and the flow path opened state is shown in FIG. 1B. The liquid flow path opening/closing device in this embodiment comprises an upper case 401 and a lower case 402, composed of a highly permeable material, and a bobbin case 403, around which a coil 404 is wound and which is stored and fixed. The upper case 401 and the lower case 402 serve as the case and the magnetic flux channel as the main body.

A highly permeable drive shaft 406 is located in a through hole formed in the center of the bobbin case 403, while the drive shaft 406 is urged by a spring (urging force exertion means) 407. On the external face of the drive shaft 406 is a flange, which the spring 407 contacts, and between the flange and the bobbin case 403 a gap 860 is defined.

An outlet joint 409 is integrally formed with the bobbin case 403, and forms an ink flow path IR that communicates with a chamber wherein the drive shaft 406 is located. The outlet joint 409 projects downward from the lower case 402 and is connected to a pipe 201.

A sealed face 801, a mirror face integrally formed with the bobbin case 403, is located at the portion, in the chamber wherein the drive shaft 406 is located, that communicates with the ink flow path IR. A rubber seal 408 is provided at the end face of the drive shaft 406 opposite the sealed face 801, and is driven against the sealed face 801 of the bobbin case 403 by the urging force exerted by the spring 407. That is, the ink flow path IR is closed or opened by a sealed portion 901 of the rubber seal 408 that is integrally formed with the drive shaft 406. In this device, when the closed portion of the ink flow path is slightly scratched to a depth equal to or less than 10 $\mu$m, an ink leakage occurs. Thus, not only is the rubber seal 408 adhered to the end face of the drive shaft 406, but also the sealed face 801 upon which the rubber sealed portion 901 abuts is formed as a mirror face.

An ink inlet is formed in the upper case 401 that communicates with the chamber wherein the drive shaft 406 is located. Further, an inlet joint 411, which forms the ink flow path, is attached to the upper case 401, and another pipe 201 is connected to the inlet joint 411.

Figure 2:
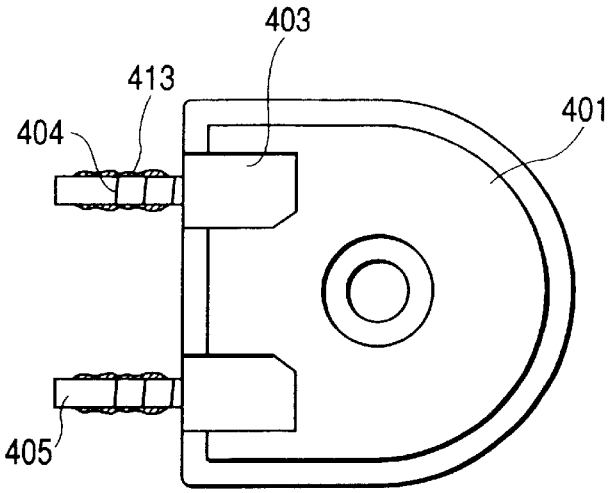
FIG. 2 is a top view of an upper case in FIGS. 1A and 1B.

FIG. 2 is a top view of the upper case 401. As is shown in FIG. 2, lead terminals 405 are introduced from the outside of the upper case 401 to supply an electrical signal to a copper line 404', for a coil (not shown), that is wound around the bobbin case 403. The copper line 404' is wound around each lead terminal 405, and is fixed by solder 413.

When, in FIGS. 1A and 1B, an electric current flows from the lead terminal 405, because of the magnetic field that is generated the drive shaft 406 releases the sealed face 801 against the urging force supplied by the spring 407, and ink 30 is supplied along the pipe 201, through the inlet joint 411 to the chamber wherein the drive shaft 406 is located. When the ink flow path IR is opened (see FIG. 1B), the ink 30 flows across a recessed flow path 852 formed in the drive shaft 406, and through a gap 860, defined between the drive shaft 406 and the bobbin case 403, to the ink flow path IR, and is finally discharged via the outlet joint 409. It should be noted that the flow path of the ink 30 may be reversed, and the ink 30 may be supplied from the outlet joint 409 and be discharged from the inlet joint 411.

Figure 3:
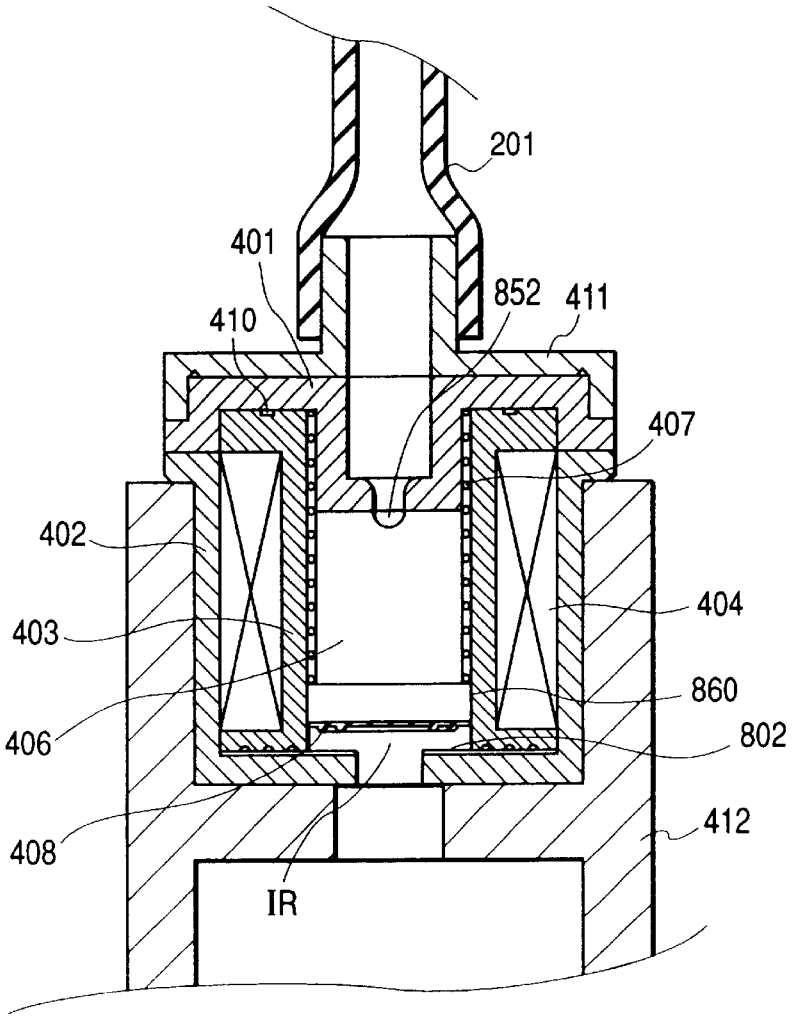
FIG. 3 is a detailed cross-sectional view of the upper case and a drive shaft in FIGS. 1A and 1B.

As is shown in FIG. 3, the faces of the upper case 401, the lower case 402 and the drive shaft 406 that contact the ink 30 are covered with an anti-corrosive layer 851 composed of polyimido that is insoluble in and does not adversely affect the ink 30.

The upper case 401 and the lower case 402, which constitute the case of the main body of the device, are secured to each other by arc spot welding, so that in turn, the bobbin case 403 and the drive shaft 406 are stably secured. With this arrangement, the magnetic flux occurring at the coil 404 is enclosed in the case constituted by the upper case 401 and the lower case 402, constructed of a highly permeable material, and is effectively used for driving the drive shaft 406, without being dispersed externally.

Since a face SG, of the upper case 401, that contacts the drive shaft 406 is located inside the coil 404, as is shown in FIGS. 1A and 1B, the direction in which the drive shaft 406 can be stabilized is the vertical. When a convex portion L, which protrudes into the area inside of the coil 404, is not provided for the upper case 401, the contact face SG is positioned outside the winding coil 404, a slight variance occurs in the drive direction, and a driving force produced by suction is reduced. However, with this configuration, since the contact face SG is inside the winding coil 404, there is no reduction in the suction force and the drive direction is stabilized.

As is shown in FIGS. 1A and 1B and 3, the rubber seal 408 has a crested shape. In the flat plane, the rubber seal 408 has, at the least, a doubled-ring convex shape that encloses the ink flow path. With this arrangement, the urging force is exerted by the spring 407, and concentrates on and deforms the summit YG of the crest portion. Thus, an extremely tiny scratch appearing on the sealed face 801 of the bobbin case 403 is also pinched-off and sealed and the leakage of the ink 30 can be prevented.

SPECIFIC EXAMPLE 1

The above embodiment will more specifically be explained.

The upper case 401 and the lower case 402 were manufactured as separate components by deep-drawing and die-cut pressing using a metal die. A cutting process may be employed instead of the deep-drawing; however, for productivity, deep-drawing is more effective. And the drive shaft 406 was manufactured by cold forging. A cutting process may also be employed; however, for productivity, cold forging is more effective.

The bobbin case 403 was manufactured by the ejection formation of polysulfone resin. Nylon, polystyrene or polycarbonate may be employed; however, while taking into account the ink solution or adverse affect on the ink, polysulfone or polypropylene, to which no smoothing agent or releasing agent has been added, is more appropriate (this material is resistant to various liquids other than ink). Further, since soldering is used to connect the ends of the winding coils 404 to the lead terminals 405, as is shown in FIG. 2, polysulfone resin, which rarely is deformed by heat during soldering, is effective.

Urethane coated copper line was wound around the bobbin case 403 300 to 2000 times to form coils 404: 300 windings of 100 μm copper line, 1000 windings of 70 μmϕ copper line and 2000 windings of 50 μmϕ copper line were used. In these instances, the resistances of the coils 404 were about 25Ω, 100Ω and 400Ω.

Then, an anti-corrosion layer 851, comprising a 7 μm polyimido evaporation layer, was deposited on the upper case 401 and the lower case 402 of the drive shaft 406. In this state, the drive shaft 406 was adhered to the fluororubber, which is the rubber seal 408, by compression at a temperature of 200° C.

The individual parts of the small solenoid valve in FIGS. 1A and 1B were prepared in this manner, and were assembled in the following manner. First, the bobbin case 403, which had been thinly coated with an epoxy resin and around which the coil 404 had been wound, was placed inside the lower case 402 at a temperature of 120° C. for forty minutes. As a result, the lower case 402 was adhered to the bobbin case 403. Then, the drive shaft 406 with the rubber seal 408 was inserted into the cylindrical chamber of the bobbin case 403, and the spring 407 was positioned above the drive shaft 406. Thereafter, chlorinated butyl rubber packing 410 was placed thereon, and the upper case 401 was placed on the packing 410. Then, the upper case 401 and the lower case 402 were aligned while they were pushed toward each other, and were adhered and secured by arc spot welding. The arc spot welding machine that was used was a YP-300, manufactured by Matsushita Electric Industrial Co., Ltd, and the welding condition was 60 amperes and 10 milliseconds. An epoxy adhesive was used to secure the inlet joint 411 to the upper case 401 of the thus obtained solenoid valve, and the ink supply pipe 201 was attached. Similarly, the pipe 201 was attached to the outlet joint 409, the outlet for the ink 30. As a result, the ink supply path was formed, and the solenoid valve, the ink flow path opening/closing device, could be positioned in the middle of the path.

In the above ink flow path opening/closing device, the ink 30 was supplied to the inlet joint 411 under a pressure of 0.2 atmosphere. As a result, since the ink flow path IR was shielded by the sealed face 801, no ink 30 leakage was noted.

When voltages of 4 V, 10 V and 20 V were applied to the coil wound with 100 μmϕ copper line, the coil wound with 70 μmϕ copper line and the coil wound with 50 μmϕ copper line, the drive shaft 406 was moved toward the upper case 401, the ink flow path IR was opened, and the ink 30 was forcibly discharged. At that time, the ink supply rate was about 3 ml/sec. Then, when the ink 30 was applied under a pressure of 0.1 atmosphere, the ink supply rate was about 1.7 ml/sec.

This ink flow path opening/closing device is optimal for an ink-jet printer: it weighs about 5 g, is about 12 mm in height and about 12 mm in diameter, requires operating power equal to or smaller than 1.2 watts, and has an operating voltage equal to or less than 20 V.

When the ink flow path IR was closed after the ink 30 was supplied, no ink 30 leakage was found.

As a further test, the distal end of the outlet pipe of the ink 30 was tightly closed by a pipe closing cock, and in this state was maintained at a temperature of 60° C. for one month, following which the cock was opened and the opening/closing device was driven. As a result, no problems were encountered, and the ink 30 was supplied at the above applied voltage.

The black ink used as the ink 30 was a pH 4 pigment ink dispersing and suspending carbon particles in a solution of pure water, ethyl glycol, isopropyl alcohol, and a surface agent. The yellow, cyan and magenta colored inks used as inks 30 were approximately pH 10 dying inks prepared by adding the dyes for the above colors to a solution of pure water, ethyl glycol and isopropyl alcohol in which uria was dissolved.

(Second Embodiment)

Figure 4:
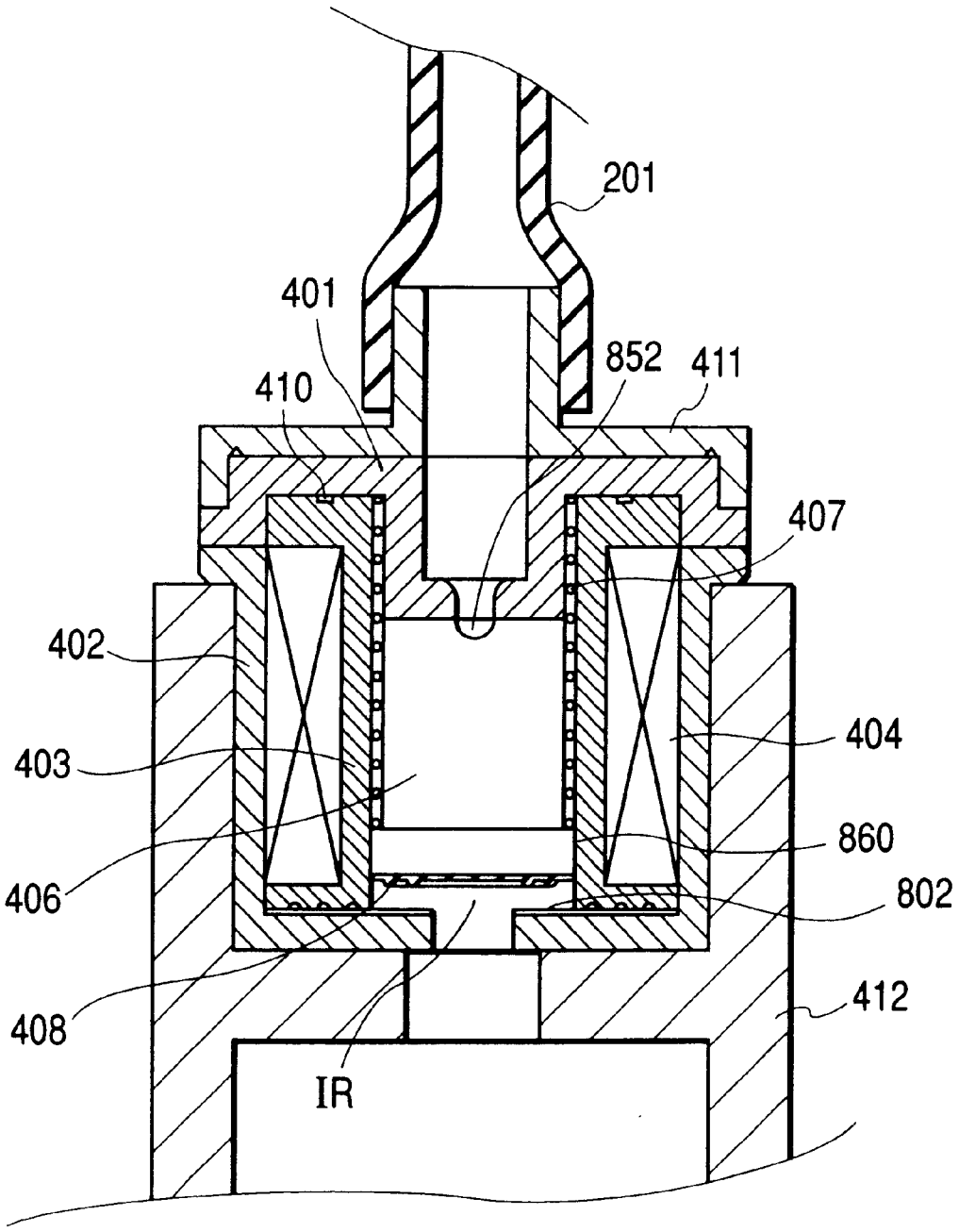
FIG. 4 is a schematic cross-sectional view for explaining the configuration of a liquid flow path opening/closing device according to a second embodiment of the present invention.
Figure 5:
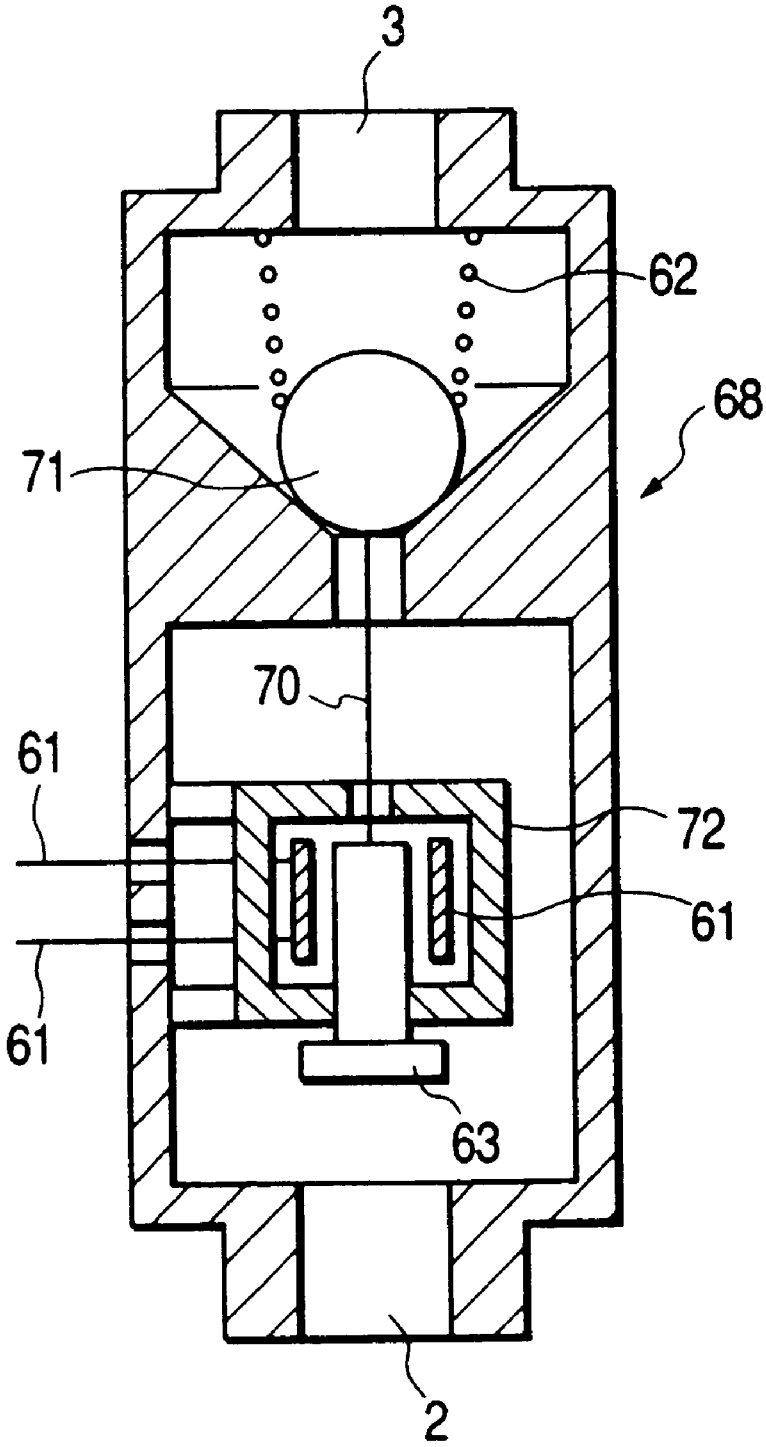
FIG. 5 (PRIOR ART)
FIG. 5 is a cross-sectional view of an example configuration for a conventional opening/closing device.
Figure 6:
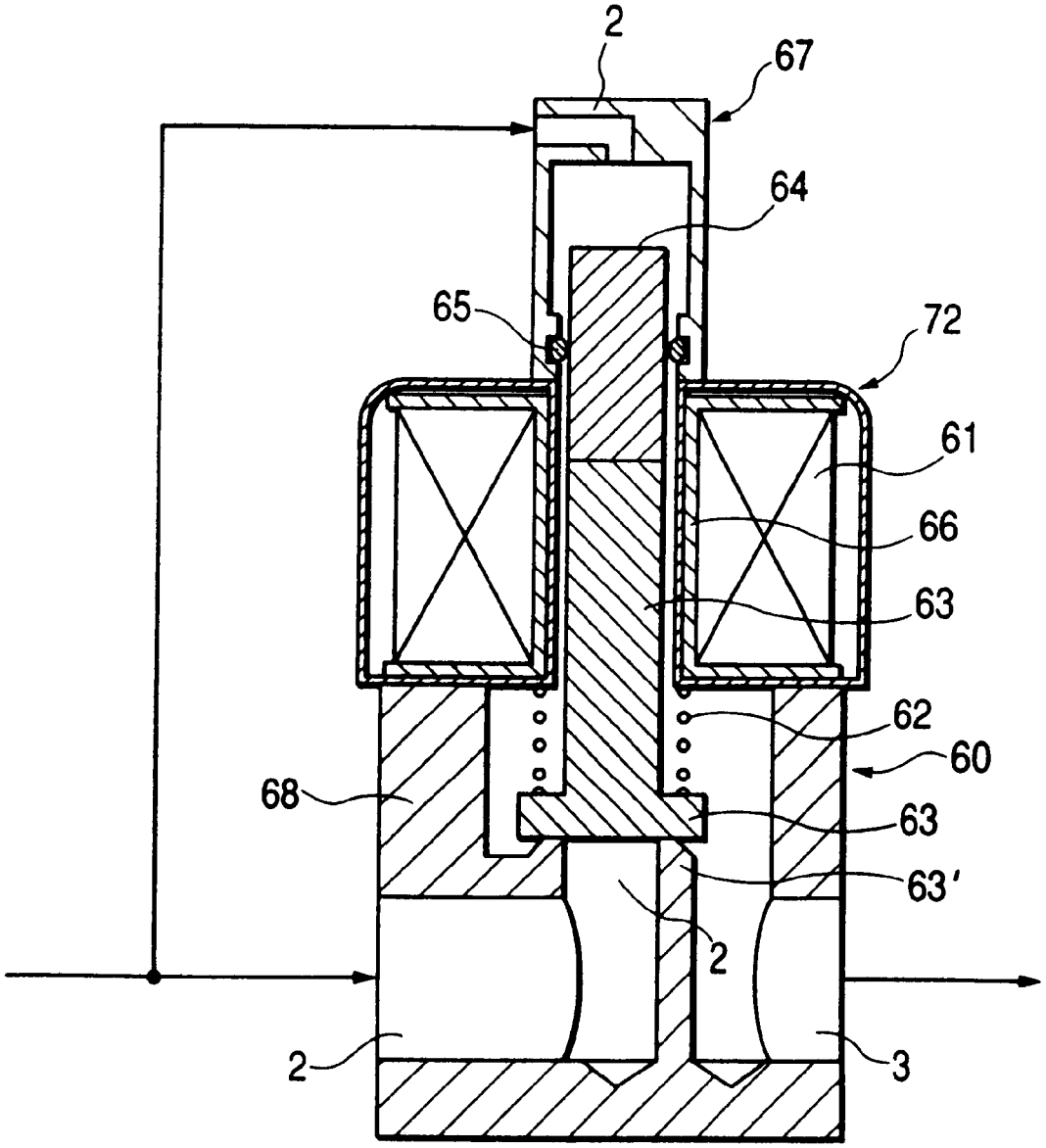
FIG. 6 (PRIOR ART)
FIG. 6 is a cross-sectional view of an example configuration for another conventional opening/closing device.

For a second embodiment, only those features that differ from the configuration of the first embodiment will be described while referring to FIG. 4. FIG. 4 is a schematic cross-sectional view for explaining the arrangement of a liquid flow path opening/closing device according to the second embodiment. In this embodiment, in FIG. 4, the face (sealed face) of a drive shaft 406 that contacts a sealing rubber 408 is constituted, not by a part of a bobbin case 403, as explained in the first embodiment, but by the recessed bottom of a lower case 402 that is formed by deep-drawing, and a coating of resin is applied to the recessed bottom to obtain a smooth face 802. In this case, a vertical through hole is formed in the bobbin case 403.

The smooth face 802 is formed by the spray painting application of an organic resin coating, and until the solvent has dried and evaporated, the coating applied to the face that was scratched during the deep-drawing process employed for manufacturing the box cases is flattened by self-leveling. The thickness of the coating is about 20 to 50 μm. Electrostatic painting or spray painting is preferable, but a uniform coating can also be applied by employing centrifugal leveling after immersion.

In addition, when the portion that corresponds to the sealed face of the lower case 402 is flat and has nearly a mirror surface with no scratches, a resin coating need not be used to form the smooth face 802, and a polyimido film, an anti-corrosive layer 851 for ink 30, may be left unchanged. However, for the sequential production of several tens of thousands of devices a day, a resin coating should be used to form the smooth face 802, because of the need to maintain a required quality.

KSF-24, produced by Tohoku Special Steel, was employed for the pair of highly permeable cases 401 and 402 that constitute the box, and KM-60, also produced by Tohoku Special Steel, was employed for a highly permeable drive shaft 406. Further, urethane coated copper line of 50 to 100 μmϕ, produced by Hitachi Cable, Ltd., was employed for a coil 404, and a method developed by Nihon Vacuum Co., Ltd. was employed to evaporate and apply polyimido, while an anti-ink ultraviolet-setting epoxy developed by Canon was employed for the spray coating or the dilution/immersion and dry coating for which epoxy resin was employed.

Polysulfone Yudel 1700, produced by Amoco, Inc., was employed for the bobbin case 403.

Fluororubber: Fluorel 707, produced by Sumitomo 3M, or Aflas, produced by Asahi Glass Co., Ltd., was employed as the rubber seal 408.

The spring 407 was formed by employing a coil that was made of 0.2ϕ 18-8 Austenite stainless line, and to which a polyimido evaporation coating of about 4 μm was applied.

SPECIFIC EXAMPLE 2

The above embodiment will now be described more specifically.

The upper case 401 and the lower case 402 were manufactured as separate components by deep-drawing and die-cut pressing using a metal die. A cutting process may be employed instead of the deep drawing; however, for productivity reasons, deep-drawing is more effective. The drive shaft 406 was manufactured by cold forging. The cutting process may be also employed for this; however, for productivity reasons, cold forging is more effective.

The bobbin case 403 was manufactured by the ejection formation of polysulfone resin. Nylon, polystyrene or polycarbonate may be employed; however, while taking into account the ink solution or the possibility that the ink may be adversely affected, polysulfone or polypropylene to which no smoothing agent or releasing agent has been added is more appropriate. Further, since soldering is used to connect the ends of the winding coils 404 to the lead terminals 405, as shown in FIG. 2, polysulfone resin, which rarely is deformed by the heat of soldering, is effective.

Urethane coated copper line was wound around the bobbin case 403 by 300 to 2000 times to form coils 404: 300 windings of 100 $\mu$mϕ copper line, 1000 windings of 70 $\mu$mϕ copper line and 2000 windings of 50 $\mu$mϕ copper line was used. The resistances of the coils 404 were about 25Ω, 100Ω and 400Ω.

Ultraviolet-setting resin was diluted with an N methyl pyrrolidone to prepare a 12% solution, and the diluted solution was sprayed on the portion that corresponds to the sealed face of the lower case 402. The resultant structure was allowed to set for thirty seconds, and then, to remove unnecessary resin, was rotated in a centrifuge at 1000 rpm for one minute. Subsequently, the lower case 402 was dried for three minutes at a temperature of 80° C., the interior was irradiated with ultraviolet light rays, and only the area in the vicinity of the sealed face was hardened. Thereafter, the lower case 402 was immersed in a methyl ethyl ketone solution for one minute to dissolve and remove extra resin, and was hardened at a temperature of 200° C.

Following this, the obtained lower case 402 was again entirely immersed in a 5% epoxy resin solution containing N methyl pyrrolidone solvent. Similarly, the removal of insoluble resin, overall irradiation with ultraviolet light rays, and drying and hardening at 200° C. were conducted. As a result, a lower case 402 was fabricated wherein a smooth face 802 was formed on the sealed face.

Next, an anti-corrosion layer 851, which is a 7 $\mu$m evaporation coating of polyimido, was deposited on the drive shaft 406 and the upper case 401. For the drive shaft 406 and the upper case 401, the immersion in and the drying of epoxy resin, and the formation of an epoxy resin coating using thermosetting may be performed. Since epoxy resin is a stable material that experiences no decomposition at temperatures below 270° C., if the thermosetting is performed at a temperature of around 250° C., the compression bonding of fluororubber to the drive shaft 406 is possible. In this manner, the entire structure can also be coated with an epoxy resin layer that is stable in the presence of ink.

In the above state, compression bonding, at a temperature of 200° C., was used to attach fluororubber, the rubber seal 408, to the drive shaft 406.

The individual parts of the small solenoid valve in FIG. 4 were prepared in this manner, and were assembled in the following manner. First, the bobbin case 403, which had been thinly coated with an epoxy resin and around which the coil 404 had been wound, was placed inside the lower case 402 at a temperature of 120° C. for forty minutes. As a result, the lower case 402 was adhered to the bobbin case 403. Then, the drive shaft 406 with the rubber seal 408 was inserted into the cylindrical chamber of the bobbin case 403, and the spring 407 was positioned above the drive shaft 406. Thereafter, chlorinated butyl rubber packing 410 was placed thereon, and the upper case 401 was placed on the packing 410. Then, the upper case 401 and the lower case 402 were aligned while they were pushed toward each other, and were adhered and secured by arc spot welding. The arc spot welding machine that was used was a YP-300, manufactured by Matsushita Electric Industrial Co., Ltd, and the welding condition was 60 amperes and 10 milliseconds. An epoxy adhesive was used to secure the inlet joint 411 to the upper case 401 of the thus obtained solenoid valve, and the ink supply pipe 201 was attached. Similarly, the pipe 201 was attached to the ink supply path at the polyethylene outlet joint 412, the outlet for the ink. As a result, the ink supply path was formed, and the solenoid valve, the ink flow path opening/closing device, could be positioned in the middle of the path.

In the above ink flow path opening/closing device, the ink 30 was supplied to the inlet joint 411 under a pressure of 0.2 atmosphere. As a result, since the ink flow path IR was shielded by the sealed face 801, no ink 30 leakage was noted.

When voltages of 4 V, 10 V and 20 V were applied to the coil 404 wound with 100 $\mu$mϕ copper line, the coil 404 wound with 70 $\mu$mϕ copper line and the coil 404 wound with 50 $\mu$mϕ copper line, the drive shaft 406 was moved toward the upper case 401, the ink flow path IR was opened, and the ink 30 was forcibly discharged. At that time, the ink supply rate was about 3 ml/sec. Then, when the ink 30 was applied under a pressure of 1.0 atmosphere, the ink supply rate was about 1.7 ml/sec.

When the ink flow path IR was closed after the ink 30 was supplied, no ink 30 leakage was found.

As a further test, the distal end of the outlet pipe of the ink 30 was tightly closed by a pipe closing cock, and in this state was maintained at a temperature of 60° C. for one month, following which the cock was opened and the opening/closing device was driven. As a result, no problems were encountered, and the ink 30 was supplied at the above applied voltage.

The black ink used as the ink 30 was a pH 4 pigment ink prepared by dispersing and suspending carbon particles in a solution of pure water, ethyl glycol, isopropyl alcohol, and a surface agent. The yellow, cyan and magenta colored inks used as inks 30 were approximately pH 10 dying inks prepared by adding the dyes for the above colors to a solution of pure water, ethyl glycol and isopropyl alcohol in which uria was dissolved.

Comparison 1

When the liquid flow path opening/closing device in the first embodiment was changed to a type wherein the sealed face 801 of the bobbin case 403 was not a mirror face, an uncountable number of scratches occurred on the surface of the lower case 402, ink could not be appropriately shielded, and the leakage of ink occurred. The ink supply rate was about 0.1 ml/sec under 0.2 atmosphere, about 0.01 ml/sec under 0.1 atmosphere, and even under 0.05 atmosphere was 1 ml/min. Although at this level it seems that leakage would account for only a small amount of ink, while taking into account the fact that for each color only about 10 to 40 ml of ink is contained in an ink tank of an ink-jet printer, it is apparent that the amount of ink an ink-jet printer consumes when printing 1000 prints could be lost in only several hours to one day. This constitutes a large problem.

Further, when a 7 to 8 $\mu$m polyimido or epoxy resin layer was formed on the sealed face 801 of the lower case 402, although leakage was reduced, it could not completely be prevented, because a 15 μm deep scratch could occur during the deep-drawing of the lower case 402.

Thus, as in the first and the second embodiments, the face (the sealed face) of the drive shaft 406 that contacts the sealing rubber 408 was formed as a flat face integrally formed with the bobbin case 403 in FIGS. 1A and 1B, or as a smooth face 802 with the resin coating shown in FIG. 3. In this manner, the quantity of the ink leakage could be drastically reduced.

However, in some cases, at an occurrence rate of 5%, a leakage of about 1 ml was observed. Through an examination of this phenomenon, it was found that when the rubber seal 408 was flat, were a scratch or a raised or recessed portion of 3 μm or smaller to occur on the flat face, ink leakage would result. Therefore, the flat shape of the rubber seal 408 was changed and it was given a summit portion YG.

With this arrangement, even when the surface of the rubber seal 408 was slightly raised or recessed, or a scratch occurred thereon, the summit portion YG was deformed by the urging force applied by the spring 407, and the splitting of the scratch or the raised or recessed portions was suppressed, so that leakage or permeation of the ink 30 could be prevented. As a result, the 5% ink leakage occurrence was eliminated.

Comparison 2

When an opening/closing device using pH 4 black ink was idled for one month at a temperature of 60° C., and when the anti-corrosion polyimido layer 851 shown in FIG. 3 was not deposited on the drive shaft 406 and the upper case 401 and the lower case 402 constituted a highly permeable box, the highly permeable material was corroded, and mold growth occurred. Thereafter, each time the drive shaft 406 was operated, mold was supplied to the ink-jet head with the ink 30 and was deposited in a filter located before the ink-jet head, causing filter clogging.

Furthermore, in some cases, mold was partially stacked up between the sealing rubber 408 and the face (sealed face) that the sealing portion contacts, and since this prevented the satisfactory shielding of the ink flow path IR, ink leakage occurred.

However, as in the first or the second embodiment, since the surfaces of the upper case 401, the lower case 402, the drive shaft 406 and the spring 407 that contact the ink 30 are covered with the polyimido or epoxy layer, the corrosion was not found at these portions contacted by the ink 30, and the closing and opening of the ink flow path IR could be preferably performed.

Furthermore, when the ink 30 is supplied from an ink tank, an about 10 μm stack of dust may accumulate at the shielded portion of the ink flow path and prevent sealing. Therefore, it is preferable that a filter be located between the ink tank and the ink inlet joint, or immediately before the ink inlet joint. Actually, when the above described ink opening/closing device was employed, a gold-plated stainless filter of 400 meshes was positioned to prevent the inflow of dust.

As is described above, the liquid flow path opening/closing device of the present invention is compact and light and consumes only 1.2 watts or less, so that it is especially appropriate for an ink-jet printer that opens and closes the ink flow path. Further, while conventionally a box or a drive shaft of a highly permeable material are manufactured by using a cutting process that raises the price, these components are manufactured by deep-drawing or cold forging, so that production of the device can be increased and manufacturing costs can be reduced. Further, the shortcoming of the method at a low cost with high productivity, i.e., the loss of flatness and smoothness due to scratches in the sealed face, can be resolved by using a resin deposited surface or a resin coated face. Thus, satisfactory sealing can be obtained, and ink leakage or permeation can be prevented.

Further, since the sealing portion of the sealing rubber is formed like a crest, shielding of the ink flow path can be improved.

The corrosion of the highly permeable material due to the ink can be prevented by forming a thin polyimido or epoxy resin layer on the surface of the highly permeable material with which the ink comes into contact. Thus, deterioration of the quality can be prevented even when a unit is stored for a long time or during the distribution process.

In addition, since fluororubber that rarely releases impurities when it is heated or expanded by ink is employed as the rubber seal, the reliability of the opening and closing operations can be increased.

What is claimed is:

1. An electromagnetic driven liquid flow path opening/closing device, for opening and closing a liquid flow path, comprising:

a highly permeable drive shaft;

urging force exertion means for impelling said drive shaft in one direction;

a bobbin case within which said drive shaft inside a cylindrical chamber is positioned;

a coil wound around the outer face of said bobbin case;

a pair of highly permeable cases in which said bobbin case around which said coil is wound and is stored; and a liquid flow path, communicating with said cylindrical chamber of said bobbin case wherein said drive shaft is positioned, wherein said liquid flow path is opened by impelling said drive shaft to counter the urging force exerted by said urging force means;

wherein a portion that is located opposite the direction in which said drive shaft is impelled by said urging force exertion means, and that contacts said drive shaft, is mounted inside said coil, in order to stabilize the shaft driving direction.

2. An electromagnetic liquid flow path opening/closing device according to claim 1, wherein said portion to which said drive shaft is impelled by said urging force exertion means is a flat face integrally formed with said bobbin case; and wherein a rubber seal is provided at that portion of said drive shaft that is secured to said flat face, so that said liquid flow path is shielded by said flat face and said rubber seal.

3. An electromagnetic liquid flow path opening/closing device according to claim 2, wherein said rubber seal is fluororubber, and the sealing portion is crest shaped.

4. An electromagnetic liquid flow path opening/closing device according to claim 2, wherein anticorrosive layers that do not adversely react with ink are deposited on the faces of said highly permeable case and said drive shaft that are directly contacted by ink.

5. An electromagnetic liquid flow path opening/closing device according to claim 4, wherein said rubber seal is fluororubber, and the sealing portion is crest shaped.

6. An electromagnetic liquid flow path opening/closing device according to claim 4, wherein said anti-corrosive layers are polyimido evaporation layers or epoxy resin coated layers.

7. An electromagnetic liquid flow path opening/closing device according to claim 6, wherein said rubber seal is fluororubber, and the sealing portion is crest shaped.

8. An electromagnetic liquid flow path opening/closing device according to claim 1, wherein said portion to which said drive shaft is impelled by said urging force exertion means is a smooth face that is coated on the bottom of a recessed portion in one of said highly permeable cases; and wherein a rubber seal is provided at that portion of said drive shaft that is secured to said smooth face, so that a seal is provided for said liquid flow path by said smooth face and said rubber seal.

9. An electromagnetic liquid flow path opening/closing device according to claim 8, wherein said rubber seal is fluororubber, and the sealing portion is crest shaped.

10. An electromagnetic liquid flow path opening/closing device according to claim 8, wherein anticorrosive layers that do not adversely react with ink are deposited on the faces of said highly permeable case and said drive shaft that are directly contacted by ink.

11. An electromagnetic liquid flow path opening/closing device according to claim 10, wherein said rubber seal is fluororubber, and the sealing portion is crest shaped.

12. An electromagnetic liquid flow path opening/closing device according to claim 10, wherein said anti-corrosive layers are polyimido evaporation layers or epoxy resin coated layers.

13. An electromagnetic liquid flow path opening/closing device according to claim 12, wherein said rubber seal is fluororubber, and the sealing portion is crest shaped.

14. An electromagnetic liquid flow path opening/closing device according to one of claims 1 to 13, which weighs equal to or less than 5 g and consumes only equal to or smaller than 1.2 watts.

15. An electromagnetic liquid flow path opening/closing device according to one of claims 1 to 13, wherein said drive shaft is manufactured by the cold forging of a highly permeable material.

16. An electromagnetic liquid flow path opening/closing device according to claim 15, which weighs equal to or less than 5 g and consumes only equal to or smaller than 1.2 watts.

17. An electromagnetic liquid flow path opening/closing device according to one of claims 1 to 13, wherein said highly permeable cases are formed by the deep-drawing of a highly permeable metal plate.

18. An electromagnetic liquid flow path opening/closing device according to claim 17, which weighs equal to or less than 5 g and consumes only equal to or smaller than 1.2 watts.

19. An electromagnetic liquid flow path opening/closing device according to claim 17, wherein said drive shaft is manufactured by the cold forging of a highly permeable material.

20. An electromagnetic liquid flow path opening/closing device according to claim 19, which weighs equal to or less than 5 g and consumes only equal to or smaller than 1.2 watts.

* * * * *